US005404123A

United States Patent [19]

Joseph

[11] Patent Number: 5,404,123

[45] Date of Patent: Apr. 4, 1995

[54] MODULAR TRANSFORMER STRUCTURE PROVIDING ENHANCED LEAKAGE INDUCTANCE AND WINDING ISOLATION

[75] Inventor: Mathew Joseph, Mesquite, Tex.

[73] Assignee: AT&T Corp., Murray Hill, N.J.

[21] Appl. No.: 24,045

[22] Filed: Mar. 1, 1993

[51] Int. Cl.[6] ..... H01F 15/10; H01F 27/30

[52] U.S. Cl. ..... 336/192; 336/206; 336/208

[58] Field of Search ..... 336/192, 198, 208, 206, 336/183, 90, 92, 196

[56] References Cited

U.S. PATENT DOCUMENTS

| | | | |
|---|---|---|---|
| 3,070,766 | 12/1962 | Purdy | 336/198 |
| 3,781,741 | 12/1973 | Weiner | 336/198 |
| 4,234,865 | 11/1980 | Shigehara | 336/192 |
| 4,714,909 | 12/1987 | Dugas | 336/198 |

FOREIGN PATENT DOCUMENTS

| | | | |
|---|---|---|---|
| 764271 | 5/1954 | Germany | 336/198 |
| 2651734 | 5/1978 | Germany | 336/198 |
| 393533 | 11/1965 | Switzerland | 336/198 |

*Primary Examiner*—Thomas J. Kozma
*Attorney, Agent, or Firm*—Charles E. Graves; Martin I. Finston

[57] ABSTRACT

A transformer structure of modular parts comprises a bobbin for supporting the primary winding, and one or more sets of end pieces sized to successively fit one over another in a nesting arrangement. The end piece flanges provide part of the secondary winding support surface. Further winding surfaces may be provided by adding further sets of end pieces which nest one within the other. The end piece flanges afford added inter-winding isolation. A double flange version of the end pieces affords still greater isolation. While applicable to small-scale transformers, the concept can also be adapted for medium and larger-size transformer designs.

6 Claims, 3 Drawing Sheets

MODULAR TRANSFORMER STRUCTURE PROVIDING ENHANCED LEAKAGE INDUCTANCE AND WINDING ISOLATION

FIELD OF THE INVENTION

This invention relates to power supply transformers and, more specifically, to a modular design for supporting the primary and other windings in transformers to provide enhanced inter-winding isolation and which is adaptable to multiple applications.

BACKGROUND OF THE INVENTION

Small-scale transformers for use in personal computers and similar equipments typically must be designed to meet the power supply requirements of the particular equipment. Designing and manufacturing individually customized transformers is costly, however. Workers in the art use where possible pre-existing configurations of winding bobbins, end caps, terminal pieces, etc. in new equipment power supplies. Often, however, use in further small transformer applications is not possible without making costly design adaptations.

Moreover, in adapting existing small scale transformer structures to new applications, it also is necessary for standard safety margins to be met. Meeting safety requirements, however, can further complicate the use of existing small-scale transformer structures in new equipments. In short, the current art lacks a transformer structure which, with little or no design modification, can find use in a variety of different equipments and also can successfully meet isolation safety margins in any of the design variations.

SUMMARY OF THE INVENTION

This invention is a small-scale transformer structure made up of modular parts. In its basic design, the structure comprises a centerpiece with bobbin for containing the primary winding. One or several pairs of end pieces along with interwinding tapes that support the secondary winding mount on the respective ends of the centerpiece. These end pieces are sized to successively fit one over the other in gang fashion to provide more winding options. The flange or shoulder of each successive ganged end piece provides a pan of the surface for the further winding, and serves as margins for meeting safety requirements. The end pieces also contain slots or grooves that secure the winding lead wires en route to the terminals.

In a particular embodiment of the invention, a female fit of the bobbin-contacting end pieces over the primary bobbin ends is provided by a pair of concentric skirts forming a double flange that extends from the end piece. The skirts place continuous insulative material over the exterior surface of the bobbin end and also into the underside on the bobbin end, to provide added electrical isolation between the windings and the core when the transformer is fully assembled.

The structures are completed by two end caps serving as terminal pieces into which the exterior faces of the end pieces fit. In both embodiments, the end caps provide a means for mounting of the assembly onto a circuit board of the equipment. Besides being modular, the structure reduces or eliminates the need for margin tapes and sleevings for meeting insulation requirements.

DETAILED DESCRIPTION OF AN ILLUSTRATIVE EMBODIMENT

Figure 1:
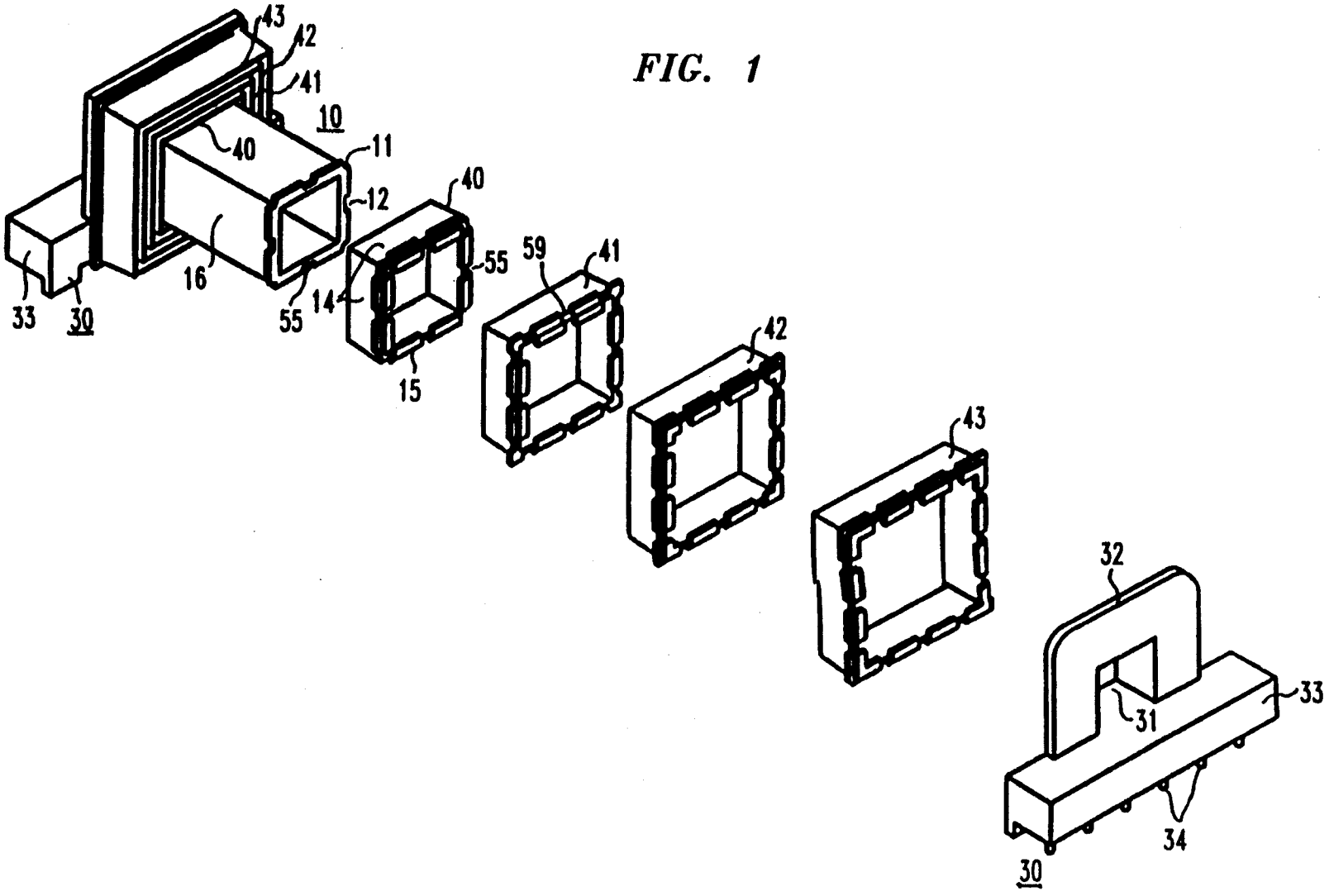
FIG. 1 is an exploded assembly diagram illustrating the transformer components using a first embodiment of end piece.
Figure 5:
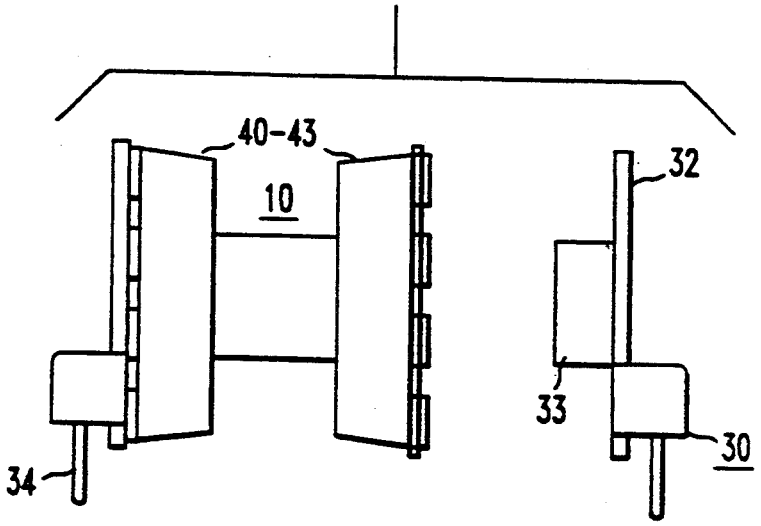
FIG. 5 is a front and side view illustrating the full assembly of the transformer components.

FIGS. 1 and 5 illustrate the inventive embodiment in which several end pieces with single flange are ganged to provide additional winding capability. The centerpiece 10 comprises a 4-sided hollow core with an exterior surface 16 and end flanges 11 having wire feed slots 12. An iron core (not shown) usually is included in the interior of the centerpiece.

In accordance with the invention, end pieces (hereinafter referred to as "first, second, third, fourth end pieces") may be ganged or stacked onto centerpiece 10. Thus, two of the first end pieces 40, consisting of a right-hand and a left-hand member, assume a position on either end of the centerpiece 10. The end pieces 40 are the interior-most pieces, seating next to the bobbin. If further windings are needed, a set of second end pieces 41 are ganged atop the end pieces 40. Similarly, if still further windings are needed for a given customized transformer, end pieces 42 and 43 may be successively ganged in sets. FIG. 1 shows several left-hand end pieces 40–43 ganged atop each other at the left end of centerpiece 10, with the right-hand end pieces 40–43 are depicted in exploded view.

The end pieces 40–43 each consist of a 4-sided winding surface 14 having an outwardly-extending flange 15 formed on one of the ends of the piece 40. The flange 15 is slotted to allow passage of the winding leads and connection thereof to the terminals 34. The interior of the surface 14 of end piece 40 is dimensioned to fit snugly over the windings. Similarly, the interiors of each successive end piece 40–43 are dimensioned to fit around the next-interior adjacent end piece.

To complete the assembly, each end of the centerpiece 10 mounts to an end cap 30. Centerpiece 10 fits over a rectangular shoulder 31 of the cap and abutts against the shoulder flange 32. The base 33 of the end cap 30 from which the flange 32 rises, contains several metallic connectors 34 to which the windings attach.

Figure 3:
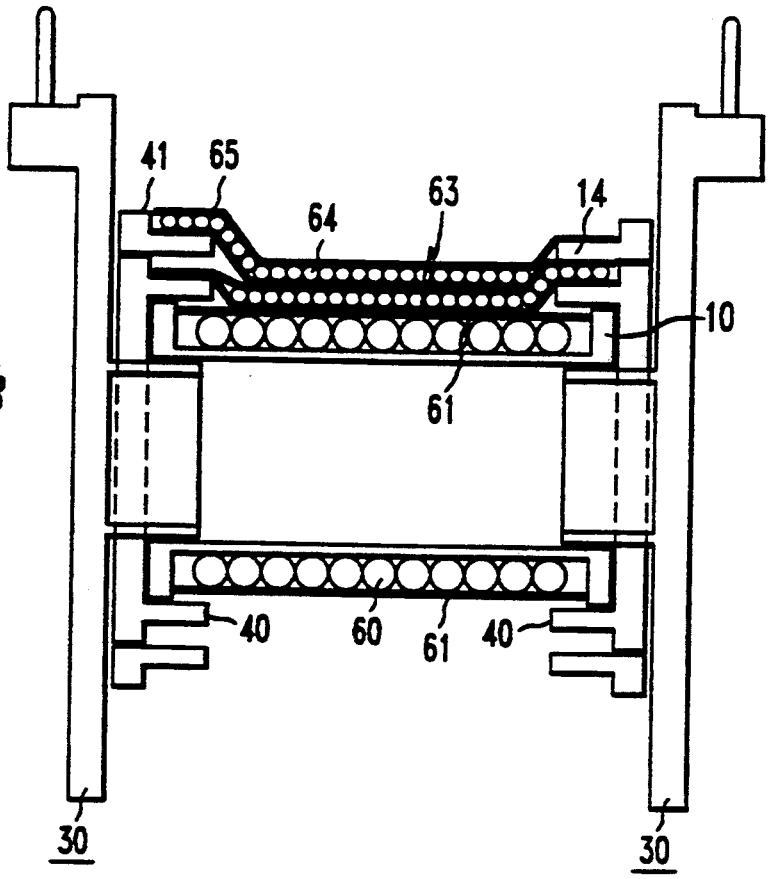
FIG. 3 is a sectional side schematic view of the transformer components of the first embodiment illustrating the winding applications.

FIG. 3 illustrates one example of the wiring of the transformer configuration of FIG. 1. A first primary winding 60 is applied; and one or more layers of insulative tape 61 are placed. The innermost end pieces 40 install over the first primary winding. The secondary winding denoted 63 installs over the tape layers 61, and extends onto the flange 14 of the end piece 40 opposite to where the primary winding is terminated. Further tape layers 62 are applied over the secondary windings, the tape extending fully over the flanges 14. By fully wrapping the tapes over the flanges of the end pieces, spacings required by safety considerations are more readily met.

End piece 41 gangs onto and over the end piece 40. A second primary winding 64 is placed over the tape layers 62, the tape extending onto the flange 14 of end piece 41. A final top layer of tape 65 goes over the second primary winding 64. The leads of the three windings exit from the assembly through convenient ones of the slots 55 formed in the piece parts as shown in FIG. 1.

Figure 2:
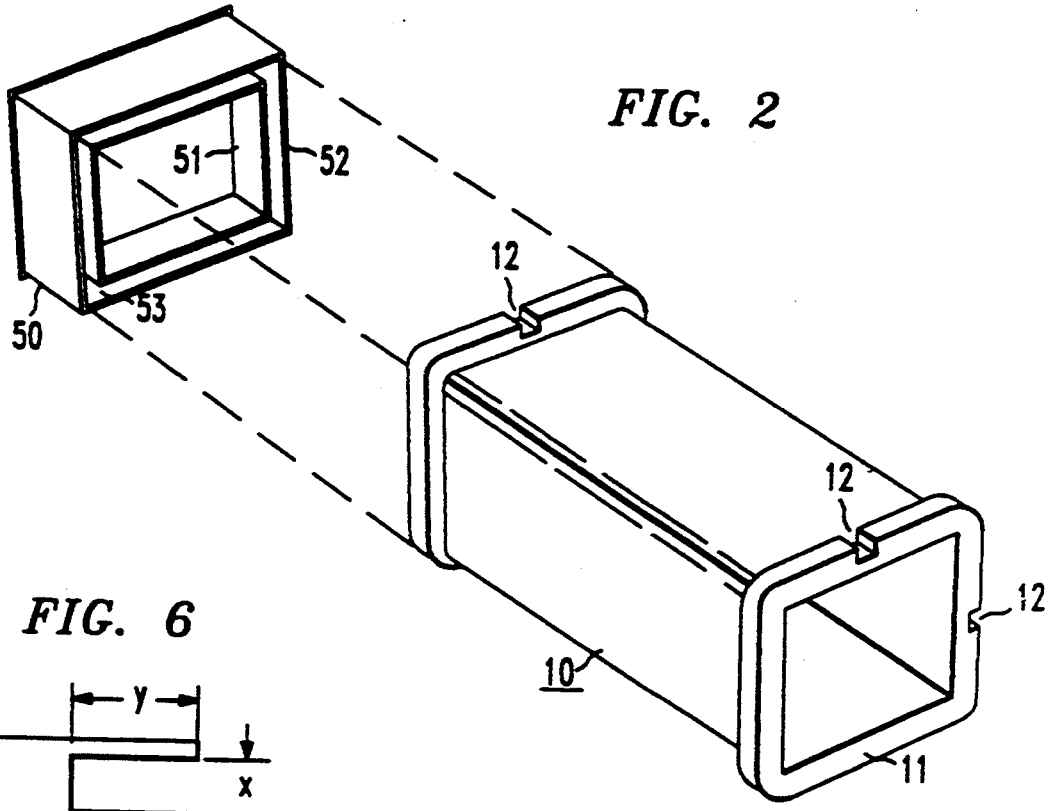
FIG. 2 is an assembly diagram illustrating the double flange version of the end piece.
Figure 4:
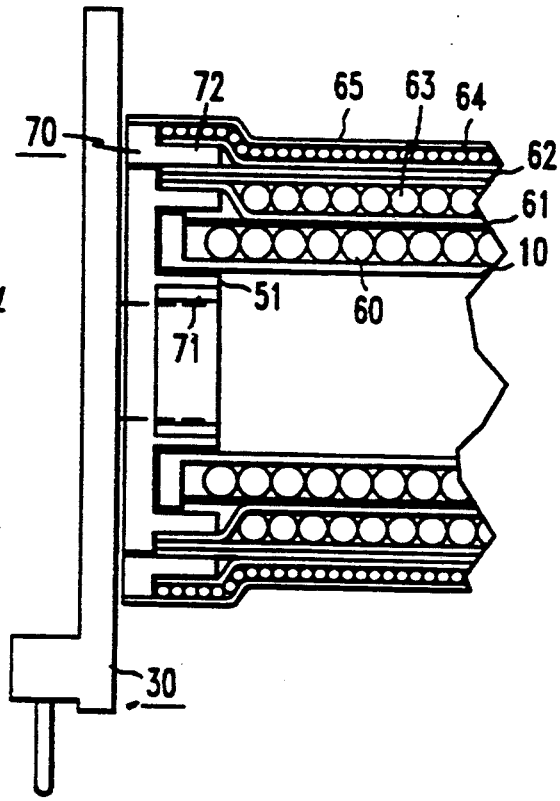
FIG. 4 is a sectional side schematic view of the transformer components using the second embodiment of end piece and illustrating the winding applications.

In accordance with another embodiment of the invention illustrated in FIG. 2, the end pieces advantageously may include a double flange that envelops both sides of the centerpiece end. This variation of end piece, denoted 50, comprises two concentric skirts or flanges 51, 52 connected by a bottom web 53. This variation of end piece may also be ganged, as illustrated in FIG. 4. The centerpiece 10 and end cap 30 serve the same purpose as already described. A first primary winding 60 is applied. The flange 51 of this embodiment of end piece extends into the centerpiece interior. The flange 52 rides over the centerpiece end and insulatively envelops the end portion of the first primary windings. Then, as in the embodiment of FIG. 3, a tape layer 61 is applied, the secondary winding 63 is laid as previously described, and a further tape layer 62 is applied to the secondary winding. If the application requires it, in accordance with this version of the invention, another double flange end piece denoted 70 is installed. The interior skirt 71 of end piece 70 fits within the interior skirt 51 of end piece 50. The outside skirt 72 rides atop the rim of end piece 50 and extends over any secondary windings that may be present. A second primary winding then is applied, beginning on the flange 72 and extending out over the tape 62. Further end pieces needed in the buildup may now be applied in gang fashion in the same manner as just described. The outermost winding is protected with a tape application such as layer 65.

Figure 6:
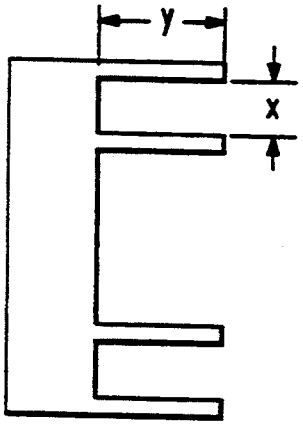
FIG. 6 is a diagram showing critical variable dimensions for the double flange version.

The inventive structure allows winding buildups without the end caps 30 making physical contact with the windings. Advantageously, the end caps may be fabricated from phenolic resin material which does not warp from contact with solder. The other components may be fabricated from Rynite/nylon material. The inventive structure allows margin tape and sleeving to be eliminated. Further, the bobbin of the centerpiece 10 may be extended horizontally as needed in a given application if it is necessary to further reduce the leakage inductance. Alteratively, referring to FIG. 6, if higher leakage inductance can be tolerated in a given application, the same iron core size (not shown) can be maintained and the windings applied one over the other with an increase in the "X" dimension (distance between skirts). By increasing the flange width dimension "Y" the same transformer design can be used for higher voltage applications.

I claim:

1. A transformer, comprising:

a) a centerpiece having a central axis, said centerpiece extending longitudinally relative to the axis, and having two respective end portions at opposite longitudinal extremes;

b) a first winding adjacent and substantially surrounding the centerpiece;

c) a second winding adjacent and substantially surrounding the first winding;

d) a third winding adjacent and substantially surrounding the second winding;

e) a first pair of mutually separated, opposing end pieces, each said end piece having an axially extending flange portion and substantially surrounding a respective centerpiece end portion; and f) a second pair of mutually separated, opposing end pieces, each said end piece having an axially extending flange portion and substantially surrounding a respective one of said first end pieces, wherein:

g) a portion of the second winding is wound on the flange portion of at least one of the first end pieces; and h) a portion of the third winding is wound on the flange portion of at least one of the second end pieces.

2. Apparatus in accordance with claim 1, wherein said centerpiece further comprises a slotted flange portion at each end, said slots adapted to pass lead wires of said windings.

3. Apparatus in accordance with claim 2, wherein each said first end piece and each said second end piece further comprises a slotted flange portion said slots adapted to pass lead wires of said windings.

4. Apparatus in accordance with claim 3, further comprising insulative tape buildup applied over each of said windings, wherein:

the second winding is underlain by a layer of said tape applied over the first winding and extending from under the second winding and onto the flange portion of at least one of the first end pieces; and the third winding is underlain by a further layer of said tape applied over the second winding and extending from under the third winding and onto the flange portion of at least one of the second end pieces.

5. Apparatus in accordance with claim 4, further comprising first and second end caps mounted to said centerpiece, each said cap having metallic termination means connecting to said respective windings.

6. Apparatus in accordance with claim 1, wherein each of said first and second of said one or more sets of end pieces comprises a double flange, one skirt of each said flange extending into the interior of said centerpiece and the other said skirt being disposed to the exterior of said centerpiece.

* * * * *